US009799189B2

(12) United States Patent
Chen et al.

(10) Patent No.: US 9,799,189 B2
(45) Date of Patent: Oct. 24, 2017

(54) TRACKING DEVICE AND TRACKING SYSTEM AND TRACKING DEVICE CONTROL METHOD

(71) Applicant: AthenTek Incorporated, Taipei (TW)

(72) Inventors: Chun-Nan Chen, Taipei (TW); Ting-Shan Kuo, Taipei (TW)

(73) Assignee: AthenTek Incorporated, Taipei (TW)

( * ) Notice: Subject to any disclaimer, the term of this patent is extended or adjusted under 35 U.S.C. 154(b) by 19 days.

(21) Appl. No.: 14/975,503

(22) Filed: Dec. 18, 2015

(65) Prior Publication Data

US 2017/0039832 A1 Feb. 9, 2017

Related U.S. Application Data

(60) Provisional application No. 62/201,177, filed on Aug. 5, 2015.

(51) Int. Cl.
*G08B 21/02* (2006.01)
*G08B 21/04* (2006.01)

(52) U.S. Cl.
CPC ..... *G08B 21/0261* (2013.01); *G08B 21/028* (2013.01); *G08B 21/0277* (2013.01); *G08B 21/0423* (2013.01)

(58) Field of Classification Search
CPC ..... G08B 21/0261; G08B 21/0277; G08B 21/028; G08B 21/0423
See application file for complete search history.

(56) References Cited

U.S. PATENT DOCUMENTS 8,111,154 B1 * 2/2012 Puri ..... G08B 21/0202 340/539.13

OTHER PUBLICATIONS

"Inferring Locations of Mobile devices from Wi-Fi Data" Wu, Leon; Zhu, Ying. Intelligent INformation Management, 2015 7, 59-69 Published Online Mar. 2015.*
Tracking Human Mobility Using WiFi Signals Sapiezynski P, Stopczynski A, Gatej R, Lehmann S (2015) Tracking Human Mobility Using WiFi Signals. Plos One 10(7): e0130824. doi: 10.1371/journal.pone.0130824.*

* cited by examiner

*Primary Examiner* — Brian Zimmerman
*Assistant Examiner* — Sara Samson

(57) ABSTRACT

A tracking device, a tracking system, and a tracking device control method with safe-zone demarcation based on the usually detected WiFi access points are provided. The tracking device includes a telecommunication transceiver, a WiFi receiver and a microcontroller. The microcontroller is configured to operate the telecommunication transceiver to transmit WiFi information to a server during a data-collection period for behavior analysis of a tracked object equipped with the tracking device and for safe-zone demarcation of the tracking device. The WiFi information indicates WiFi access points detected by the WiFi receiver. The safe-zone demarcation of the tracking device is adaptive to habitual behaviors, obtained from the behavior analysis, of the tracked object.

6 Claims, 10 Drawing Sheets

400

| | Weekdays | | | | | | | Weekdays | |
|---|---|---|---|---|---|---|---|---|---|
| | 1 | 2 | 3 | 4 | 5 | 6 | 7 | 8 | 9 |
| 00:00~07:00 | WiFi_Home | WiFi_Home | WiFi_Home | WiFi_Home | WiFi_Home | WiFi_Home | WiFi_Home | WiFi_Home | WiFi_Home |
| 07:00~08:00 | WiFi_SB & WiFi_NS1 | WiFi_SB & WiFi_NS1 | WiFi_SB & WiFi_NS1' | WiFi_SB & WiFi_NS1" | WiFi_SB & WiFi_NS1 | WiFi_Home | WiFi_NS6 | WiFi_SB & WiFi_NS1 | WiFi_SB & WiFi_NS1 |
| 08:00~12:00 | WiFi_S1 & WiFi_S2 | WiFi_S1 & WiFi_S2 | WiFi_S1 & WiFi_S2 | WiFi_S1 & WiFi_S2 | WiFi_S1 & WiFi_S2 | WiFi_Home | WiFi_O2 | WiFi_S1 & WiFi_S2 | WiFi_S1 & WiFi_S2 |
| 12:00~13:00 | WiFi_SB & WiFi_NS2 | WiFi_SB & WiFi_NS2 | WiFi_SB & WiFi_NS2 | WiFi_SB & WiFi_NS2 | WiFi_SB & WiFi_NS2 | WiFi_NS4 | WiFi_O2 | WiFi_SB & WiFi_NS2 | WiFi_SB & WiFi_NS2 |
| 13:00~17:00 | WiFi_AS | WiFi_AS | WiFi_AS | WiFi_AS | WiFi_AS | WiFi_O1 | WiFi_O2 | WiFi_AS | WiFi_AS |
| 17:00~18:00 | WiFi_NS3 | WiFi_NS3 | WiFi_NS3 | WiFi_NS3 | WiFi_NS3 | WiFi_NS5 | WiFi_NS7 | WiFi_NS3 | WiFi_NS3 |
| 18:00~00:00 | WiFi_Home | WiFi_Home | WiFi_Home | WiFi_Home | WiFi_Home | WiFi_Home | WiFi_Home | WiFi_Home | WiFi_Home |

| FIG. 4A | FIG. 4B | FIG. 4C | FIG. 4D |
|---|---|---|---|

FIG. 4A

Weekdays

| | 10 | 11 | 12 | 13 | 14 | 15 | 16 | 17 | 18 |
|---|---|---|---|---|---|---|---|---|---|
| 00:00~07:00 | WiFi_Home | WiFi_Home | WiFi_Home | WiFi_Home | WiFi_Home | WiFi_Home | WiFi_Home | WiFi_Home | WiFi_Home |
| 07:00~08:00 | WiFi_SB & WiFi_NS1' | WiFi_SB & WiFi_NS1' | WiFi_SB & WiFi_NS1" | WiFi_Home | WiFi_NS6 | WiFi_SB & WiFi_NS1 | WiFi_SB & WiFi_NS1' | WiFi_SB & WiFi_NS1' | WiFi_SB & WiFi_NS1 |
| 08:00~12:00 | WiFi_S1 & WiFi_S2 | WiFi_S1 & WiFi_S2 | WiFi_S1 & WiFi_S2 | WiFi_Home | WiFi_O2 | WiFi_S1 & WiFi_S2 | WiFi_S1 & WiFi_S2 | WiFi_S1 & WiFi_S2 | WiFi_S1 & WiFi_S2 |
| 12:00~13:00 | WiFi_SB & WiFi_NS2 | WiFi_SB & WiFi_NS2 | WiFi_SB & WiFi_NS2 | WiFi_NS4 | WiFi_O2 | WiFi_SB & WiFi_NS2 | WiFi_NSA | WiFi_SB & WiFi_NS2 | WiFi_SB & WiFi_NS2 |
| 13:00~17:00 | WiFi_AS | WiFi_AS | WiFi_AS | WiFi_O1 | WiFi_O2 | WiFi_AS | WiFi_AS | WiFi_AS | WiFi_AS |
| 17:00~18:00 | WiFi_NS3 | WiFi_NS3 | WiFi_NS3 | WiFi_NS5 | WiFi_NS7 | WiFi_NS3 | WiFi_NS3 | WiFi_NS3 | WiFi_NS3 |
| 18:00~00:00 | WiFi_Home | WiFi_Home | WiFi_Home | WiFi_Home | WiFi_Home | WiFi_Home | WiFi_Home | WiFi_Home | WiFi_Home |

FIG. 4B

Weekdays

| | 19 | 20 | 21 | 22 | 23 | 24 | 25 | 26 | 27 |
|---|---|---|---|---|---|---|---|---|---|
| 00:00~07:00 | WiFi_Home | WiFi_Home | WiFi_Home | WiFi_Home | WiFi_Home | WiFi_Home | WiFi_Home | WiFi_Home | WiFi_Home |
| 07:00~08:00 | WiFi_SB & WiFi_NS1" | WiFi_Home | WiFi_NS6 | WiFi_SB & WiFi_NS1 | WiFi_SB & WiFi_NS1' | WiFi_SB & WiFi_NS1 | WiFi_SB & WiFi_NS1" | WiFi_SB & WiFi_NS1 | WiFi_Home |
| 08:00~12:00 | WiFi_S1 & WiFi_S2 | WiFi_Home | WiFi_O2 | WiFi_S1 & WiFi_S2 | WiFi_S1 & WiFi_S2 | WiFi_S1 & WiFi_S2 | WiFi_S1 & WiFi_S2 | WiFi_S1 & WiFi_S2 | WiFi_Home |
| 12:00~13:00 | WiFi_SB & WiFi_NS2 | WiFi_NS4 | WiFi_O2 | WiFi_SB & WiFi_NS2 | WiFi_SB & WiFi_NS2 | WiFi_SB & WiFi_NS2 | WiFi_SB & WiFi_NS2 | WiFi_SB & WiFi_NS2 | WiFi_NS4 |
| 13:00~17:00 | WiFi_AS | WiFi_O1 | WiFi_O2 | WiFi_AS | WiFi_AS | WiFi_AS | WiFi_AS | WiFi_AS | WiFi_O1 |
| 17:00~18:00 | WiFi_NS3 | WiFi_NS5 | WiFi_NS7 | WiFi_NS3 | WiFi_NS3 | WiFi_NS3 | WiFi_NS3 | WiFi_NS3 | WiFi_NS5 |
| 18:00~00:00 | WiFi_Home | WiFi_Home | WiFi_Home | WiFi_Home | WiFi_Home | WiFi_Home | WiFi_Home | WiFi_Home | WiFi_Home |

FIG. 4C

| | | Weekdays | |
|---|---|---|---|
| | 28 | 29 | 30 |
| 00:00~07:00 | WiFi_Home | WiFi_Home | WiFi_Home |
| 07:00~08:00 | WiFi_NS6 | WiFi_SB & WiFi_NS1' | WiFi_SB & WiFi_NS1 |
| 08:00~12:00 | WiFi_O2 | WiFi_S1 & WiFi_S2 | WiFi_S1 & WiFi_S2 |
| 12:00~13:00 | WiFi_O2 | WiFi_SB & WiFi_NS2 | WiFi_SB & WiFi_NS2 |
| 13:00~17:00 | WiFi_O2 | WiFi_AS | WiFi_AS |
| 17:00~18:00 | WiFi_NS7 | WiFi_NS3 | WiFi_NS3 |
| 18:00~00:00 | WiFi_Home | WiFi_Home | WiFi_Home |

FIG. 4D

TRACKING DEVICE AND TRACKING SYSTEM AND TRACKING DEVICE CONTROL METHOD

CROSS REFERENCE TO RELATED APPLICATIONS

This application claims the benefit of U.S. Provisional Application No. 62/201,177, filed on Aug. 5, 2015, the entirety of which is incorporated by reference herein.

BACKGROUND OF THE INVENTION

Field of the Invention

The present invention relates to a tracking system.

Description of the Related Art

A tracking system is used for observing persons or objects on the move and supplying a timely ordered sequence of respective location data to a server. A tracking system may employ a tracking device that is applied to the object being tracked and that transmits an alarm and message when the tracked object leaves a safe zone as defined by geo-fencing or a specially designed wireless beacon.

A geo-fence is a virtual perimeter around a predefined location or a predefined set of boundaries. Only stationary safe zones are built by geo-fencing. As for a safe zone defined by a specially designed wireless beacon, a burn-in process is required to register the specially designed wireless beacons to a memory (e.g. a ROM) of the tracking device.

BRIEF SUMMARY OF THE INVENTION

A tracking device, a tracking system, and a tracking device control method with safe-zone demarcation based on the usually detected WiFi access points are disclosed.

A tracking device in accordance with an exemplary embodiment of the disclosure includes a telecommunication transceiver, a WiFi receiver and a microcontroller. The microcontroller is configured to operate the telecommunication transceiver to transmit WiFi information to a server during a data-collection period for behavior analysis of a tracked object (a person, a pet, or a thing) equipped with the tracking device and for safe-zone demarcation of the tracking device. The WiFi information indicates WiFi access points detected by the WiFi receiver. The safe-zone demarcation of the tracking device is adaptive to habitual behaviors, obtained from the behavior analysis, of the tracked object.

A tracking system including the aforementioned tracking device and sever is also introduced in this paper.

In another exemplary embodiment, a tracking-device control method is disclosed, including the following steps: providing a server for a tracking device; operating a WiFi receiver of the tracking device and thereby obtaining WiFi information indicating WiFi access points detected by the WiFi receiver; and operating a telecommunication transceiver of the tracking device to transmit the WiFi information to the server during a data-collection period for behavior analysis of a tracked object equipped with the tracking device and for safe-zone demarcation of the tracking device, wherein the safe-zone demarcation of the tracking device is adaptive to habitual behaviors, obtained from the behavior analysis, of the tracked object.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein:

FIG. 4A-4D show a collection table 400 of WiFi information collected by the tracking device 100 carried by the child, which is organized from the WiFi information uploaded during a data-collection period, wherein the data-collection period contains N days, and N is 30;

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
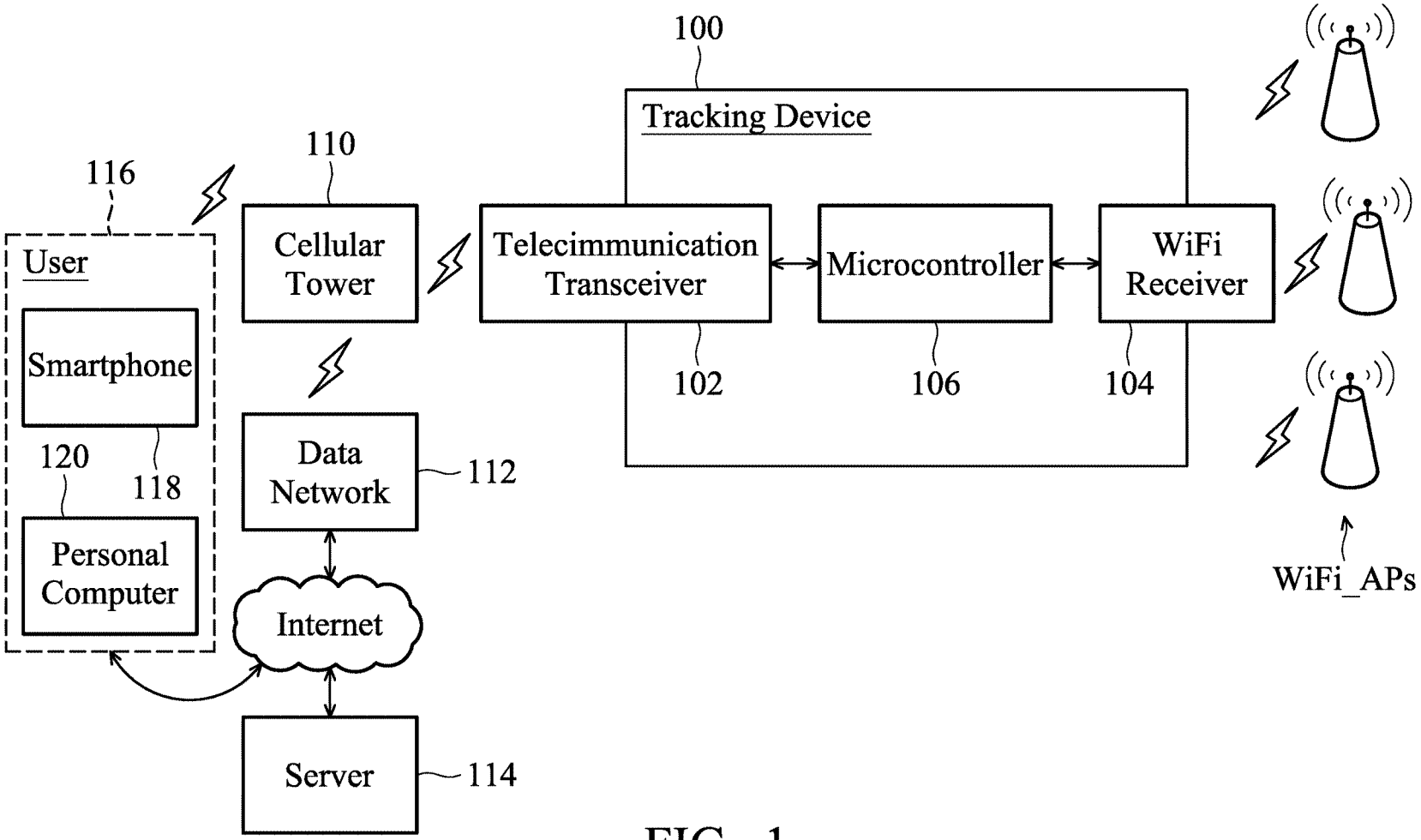
FIG. 1 is a block diagram depicting a tracking system using a tracking device 100 in accordance with an exemplary embodiment of the disclosure.

FIG. 1 is a block diagram depicting a tracking system using a tracking device 100 in accordance with an exemplary embodiment of the disclosure. As shown, the tracking device of FIG. 1 comprises a server 114. The tracking device 100 includes a telecommunication transceiver 102, a WiFi receiver 104, and a microcontroller 106. The telecommunication transceiver 102, e.g., a GSM transceiver, a 3G transceiver and so on, is provided for digital cellular communication. The WiFi receiver 104 is provided to detect WiFi signals and thereby WiFi information indicating the WiFi access points WiFi_APs detectable to the tracking device 100 is obtained. The telecommunication transceiver 102 and the WiFi receiver 104 are controlled by the microcontroller 106.

During a data-collection period, the microcontroller 106 is configured to operate the telecommunication transceiver 102 to transmit the WiFi information to be received by a cellular tower 110 and then conveyed to a data network 112 and uploaded from the data networks 112 to the server 114 through the Internet. Based on the WiFi information collected during the data-collection period, a behavior analysis of a tracked object equipped with the tracking device 100 is performed by the server 114. Based on the behavior analysis, habitual behaviors of the tracked object are obtained. The server 114 performs a safe-zone demarcation for the tracking device 100 based on the habitual behaviors obtained from the behavior analysis. In an exemplary embodiment, the tracking device 100 is regarded as being located within a safe zone when the WiFi receiver 104 detects any of the trustworthy WiFi access points approved by the server 114 for the current time slot in accordance with the behavior analysis. In comparison with a conventional safe-zone demarcation (in a virtual perimeter around a predefined location or within a predefined set of boundaries or around a predefined wireless beacon), the safe-zone demarcation of the disclosure is adaptive to the habitual behaviors of the tracked object and the exact latitude and longitude is not required. A high precision, expensive positioning module (e.g. GPS) is not necessary to determine whether the user is in a safe zone or is leaving the safe zone. The tracking device of the disclosure may precisely monitor whether the user is in a safe zone based on just WiFi detection. Note that the WiFi information is not limited to being collected from registered WiFi beacons those with exact position information. No matter whether position information is available or not, WiFi APs detected by the WiFi receiver 104 during the data-collection period are all taken into consideration in the behavior analysis. According to this paper, the habitual behaviors of the tracked object may be purely obtained from WiFi information without any position information. In a mature environment with WiFi technology, a positioning module, e.g. a GPS module, is not required in the tracking device 100 for a more economical solution.

The user 116 of the tracking device 100 may operate a personal computing device (a smartphone 118, a personal computer 120 and so on) to monitor the tracking device 100. When the tracked object equipped with the tracking device 100 is not within the safe zone defined according to the habitual behaviors of the tracked object, the server 114 may notify the user 116 through digital cellular communication or the Internet to transmit a message to the smartphone 118 or personal computer 120 of the user 116.

Figure 2:
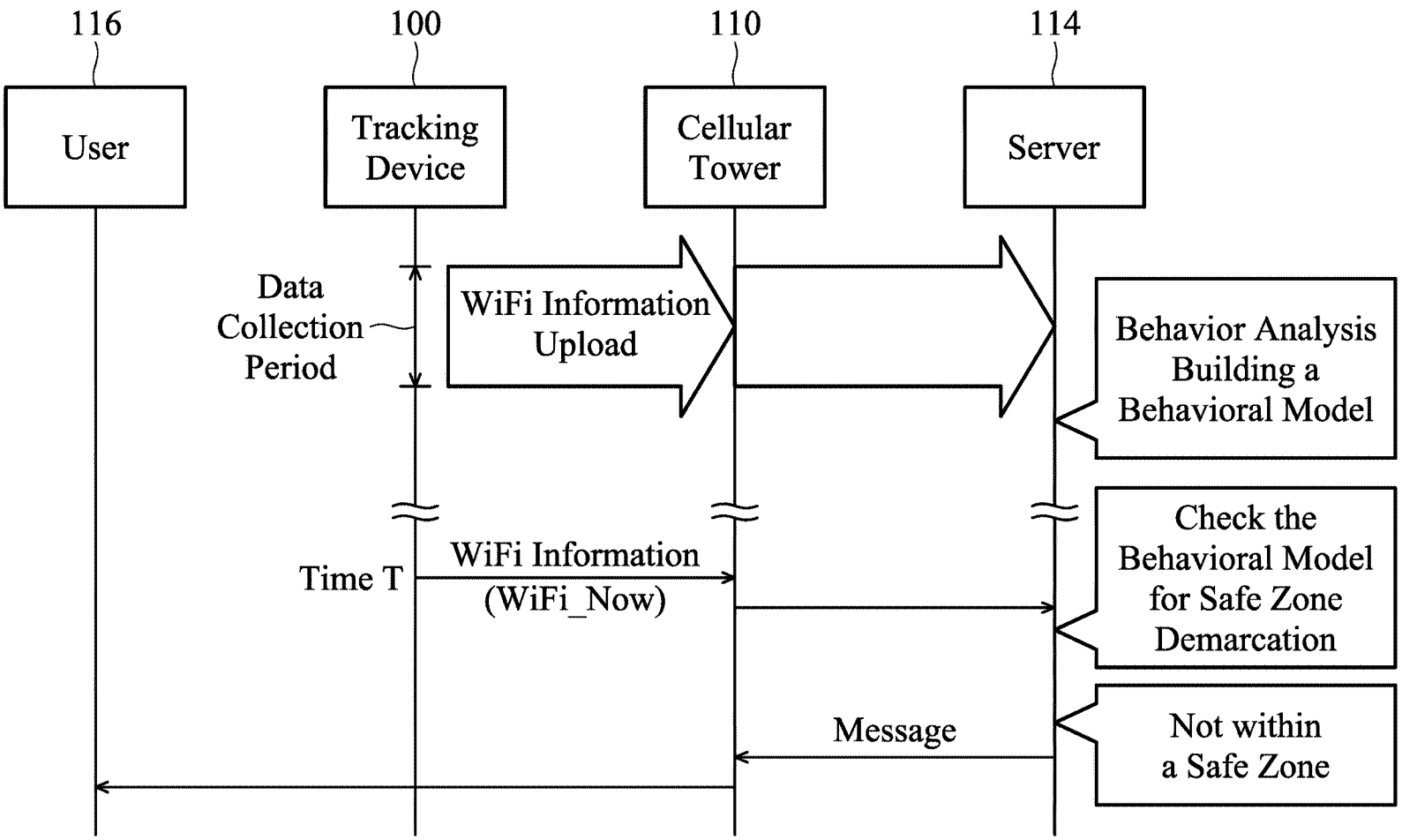
FIG. 2 is a call-flow diagram for controlling the tracking device 100, showing how a behavioral model of a tracked object equipped with the tracking device 100 is built and how the behavioral model is applied to safe-zone demarcation.

FIG. 2 is a call-flow diagram for controlling the tracking device 100, showing how a behavioral model of a tracked object equipped with the tracking device 100 is built and how the behavioral model is applied to safe-zone demarcation. As shown, during a data-collection period, the tracking device 100 uploads WiFi information to the server 114 through the cellular tower 110. The WiFi information indicates the WiFi APs detection by the WiFi receiver 104 during the data-collection period. The server 114 performs behavior analysis based on the WiFi information collected during the data-collection period, to build a behavioral model of the tracked object. In accordance with the behavior analysis, trustworthy WiFi APs are approved by the server 114 for the different time slots. At time T after the data-collection period, the tracking device 100 transmits WiFi information WiFi_Now to the server 114 through the cellular tower 110. The server 114 checks the behavioral model with respect to the time slot corresponding to time T. A safe-zone demarcation based on the behavioral model is activated when there are any trustworthy APs approved for the time slot corresponding to time T. When the WiFi information WiFi_Now at time T shows that at least one of the trustworthy WiFi APs of the time slot corresponding to time T is detected by the WiFi receiver 104, the tracking device 100 is regarded as being located within a safe zone. When none of the trustworthy WiFi APs of the time slot corresponding to time T are indicated in the WiFi information WiFi_Now, the server 114 transmits a message through the cellular tower 110 to the user 116. The user 116 is notified of the status of the tracked object.

In another exemplary embodiment, the data collection for behavior analysis is always on (e.g. extended with the running of the tracking device 100). The data-collection period is regularly repeated and thereby changes of the habitual behaviors of the tracked device are updated in real time. Thus, the behavioral model is updated in real time.

In the following paragraphs, an example is described to show how a behavioral model of a tracked object equipped with the tracking device 100 is established and how the behavioral model is applied to demarcate intelligent safe zones.

Figure 3:
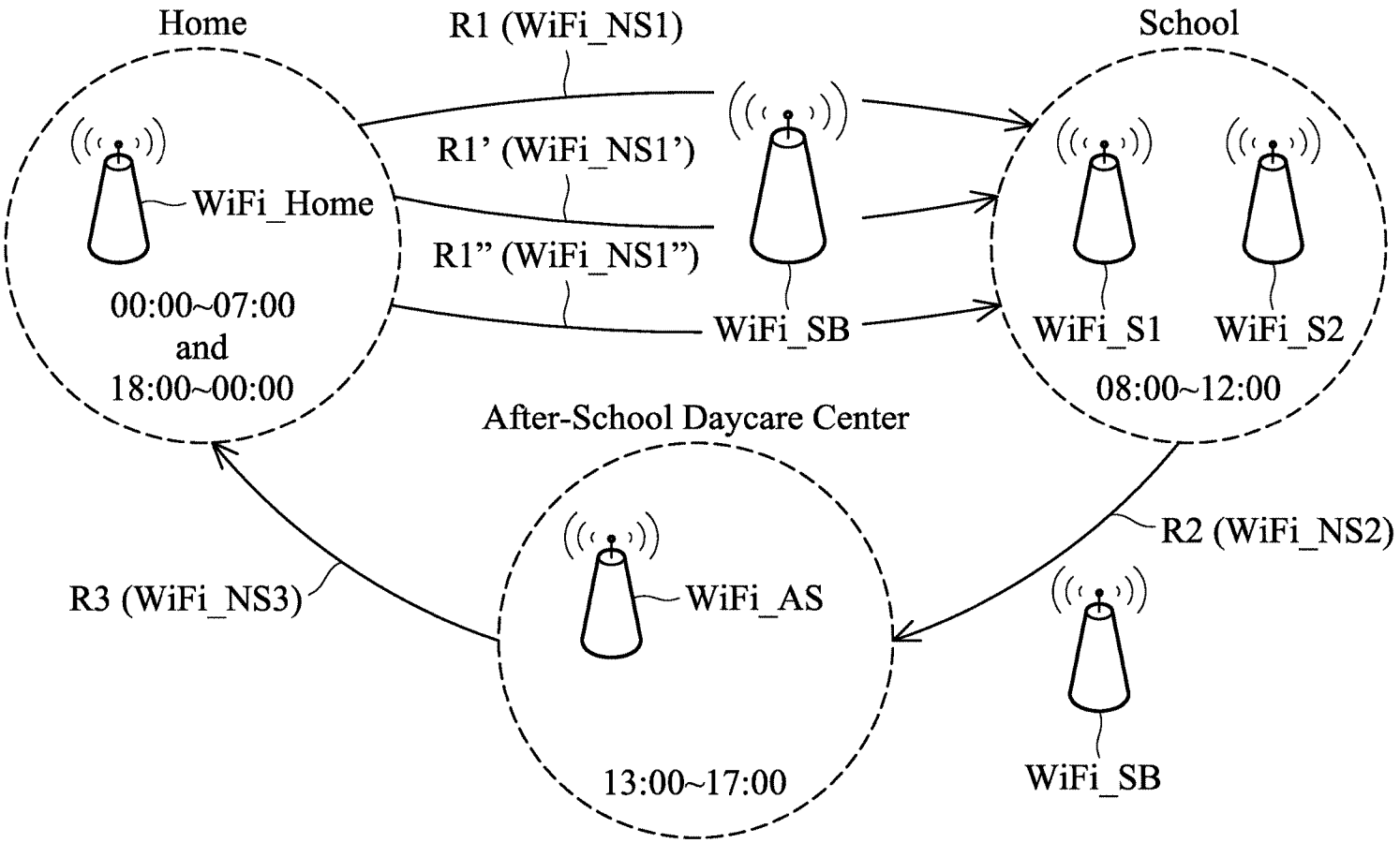
FIG. 3 illustrates a weekday routine of a tracked object (the child of the user)

FIG. 3 illustrates a weekday routine of a tracked object (the child of the user). The child stays at home from 00:00 to 7:00 and 18:00 to 00:00, stays at school from 08:00 to 12:00, and stays at an after-school daycare center from 13:00 to 17:00. From 07:00 to 08:00, the child takes the school bus and travels from home to school on any of the bus routes R1, R1' and R1". From 12:00 to 13:00, the child takes the school bus and travels from school to the after-school daycare center on a regular after-school route R2. From 17:00 to 18:00, the child travels from the after-school daycare center to home by himself (regarded as route R3). The child wears the tracking device 100 or carries the tracking device 100 throughout the day. When staying at home, the tracking device 100 detects a WiFi AP WiFi_Home fixed at home. When staying at school, the tracking device 100 detects multiple fixed WiFi APs WiFi_S1 and WiFi_S2 at school. When staying at the after-school daycare center, the tracking device 100 detects a fixed WiFi AP WiFi_AS at the after-school daycare center. There is a WiFi AP WiFi_SB on the school bus. Along the school bus route R1, dynamic WiFi information WiFi_NS1 including complex WiFi signals from WiFi APs set along route R1 is also collected by the tracking device 100, which may change slightly every day. Along the school bus route R1', dynamic WiFi information WiFi_NS1' including complex WiFi signals from WiFi APs set along route R1' is also collected by the tracking device 100, which may change slightly every day. Along the school bus route R1", dynamic WiFi information WiFi_NS1' including complex WiFi signals from WiFi APs set along route R1" is also collected by the tracking device 100, which may change slightly every day. Along the school bus route R2, dynamic WiFi information WiFi_NS2 including complex WiFi signals from WiFi APs set along route R2 is also collected by the tracking device 100, which may change slightly every day. Along the child's route R3, dynamic WiFi information WiFi_NS3 including complex WiFi signals from WiFi APs set along route R3 is collected by the tracking device 100, which may be more irregular and should be paid more attention.

FIGS. 4A-4D show a collection table 400 of WiFi information collected by the tracking device 100 carried by the child, which is organized from the WiFi information uploaded during a data-collection period, wherein the data-collection period contains N days and N is 30. On the weekdays, the uploaded WiFi information shows that the child followed the weekday routine of FIG. 3, except for the $16^{th}$ day, when the child traveled from school to the after-school day care center along another route RA rather than the regular after-school route R2. Along the unusual route RA, the detected WiFi information WiFi_RA is much different from the WiFi information WiFi_NS2 collected during the other weekdays. Every Saturday, the child left home at 12:00 and traveled to position O1 along route R4 from 12:00 to 13:00 and stayed in position O1 till 17:00 and returned home along route R5 from 17:00 to 18:00. Along the route R4, dynamic WiFi information WiFi_NS4 including complex WiFi signals from WiFi APs set along route R4 is collected by the tracking device 100 and may change slightly every Saturday. When staying at position O1, the tracking device 100 detects a fixed WiFi AP WiFi_O1 at position O1. Along the route R5, dynamic WiFi information WiFi_NS5 including complex WiFi signals from WiFi APs set along route R5 is collected by the tracking device 100 and may change slightly every Saturday. Every Sunday, the child left home at 07:00 and traveled to position O2 along route R6 from 07:00 to 08:00 and stayed in position O2 till 17:00 and returned home along route R7 from 17:00 to 18:00. Along the route R6, dynamic WiFi information WiFi_NS6 including complex WiFi signals from WiFi APs set along route R6 is collected by the tracking device 100 and may change slightly every Sunday. When staying at position O2, the tracking device 100 detects a fixed WiFi AP WiFi_O2 at position O2. Along the route R7, dynamic WiFi information WiFi_NS7 including complex WiFi signals from WiFi APs set along route R7 is collected by the tracking device 100 and may change slightly every Sunday.

Based on the table 400, a behavioral model of the child equipped with the tracking device 100 is built up. Only WiFi detection is required. It is not necessary to collect the high precision position information.

Figure 5:
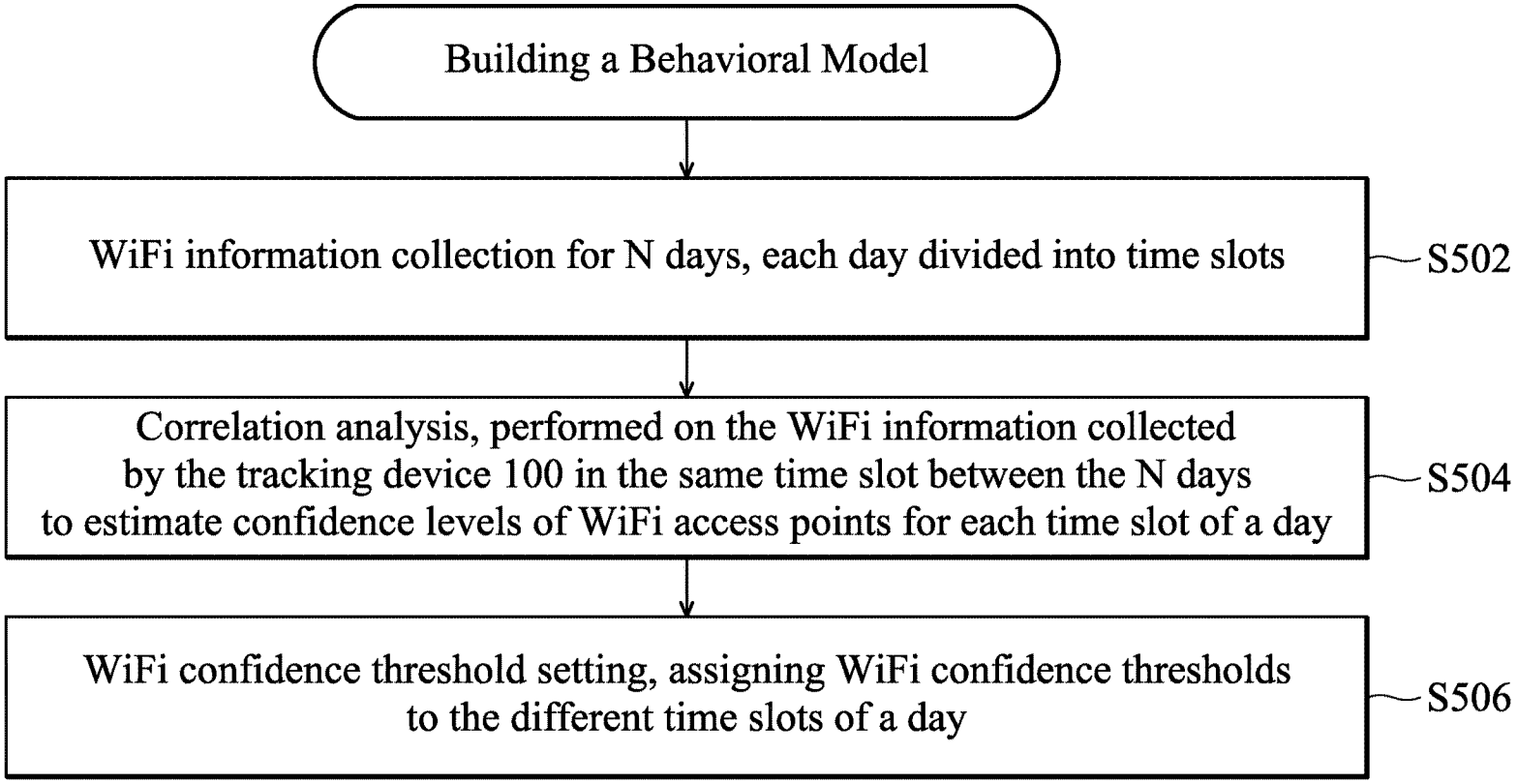
FIG. 5 is a flowchart depicting how a behavioral model of the tracked device is established in accordance with an exemplary embodiment of the disclosure.

FIG. 5 is a flowchart depicting how a behavioral model of the tracked device is established in accordance with an exemplary embodiment of the disclosure.

In step S502, a WiFi information collection is performed N days and each day is divided into time slots. As shown in table 400, the WiFi information collection lasts 30 days and each day is divided into 24 time slots and the WiFi information of the tracked object during the different times slots of the 30 days are recorded. During the 30 days, the tracked object appeared at home, school, after-school daycare center or position O1 or O2 or on any of routes R1, R1', R1", RA and R2 to R7.

In step S504, a correlation analysis is performed on the WiFi information collected by the tracking device 100 in the same time slot between the N days, to estimate confidence levels of WiFi APs for each time slot of a day. Step S504 is discussed in detail in the following with respect to table 400. From 00:00 to 07:00 and from 18:00 to 00:00 in the 30 days, the tracking device 100 always detected the WiFi AP WiFi_Home fixed at home. The WiFi AP WiFi_Home corresponds to a confidence level 100% during the time slots 00:00~07:00 and 18:00~00:00. As for the time slot 07:00~08:00, the fixed WiFi AP WiFi_SB corresponds to a confidence level 22/30, the fixed WiFi AP WiFi_Home corresponds to a confidence level 4/30 and the signals indicated in the dynamic WiFi information WiFi_NS1, WiFi_NS1' and WiFi_NS1" may correspond to different confidence levels (from 1/30 to 30/30) depending on how many times the corresponding WiFi AP was detected by the tracking device 100 during the time slot 07:00~08:00 in the 30 days. As for the time slot 08:00~12:00, the WiFi AP WiFi_S1 and WiFi_S2 at school both correspond to a confidence level 22/30, the WiFi AP WiFi_Home at home corresponds to a confidence level 4/30 and the WiFi AP WiFi_O2 in position O2 corresponds to a confidence level 4/30. As for the time slot 12:00~13:00, the WiFi AP WiFi_SB on the school bus corresponds to a confidence level 22/30, the WiFi AP the WiFi AP WiFi_O2 in position O2 corresponds to a confidence level 4/30, and the signals indicated in the dynamic WiFi information WiFi_NS2, WiFi_NSA and WiFi_NS4 may correspond to different confidence levels (from 1/30 to 30/30) depending on how many times the corresponding WiFi AP was detected by the tracking device 100 during the time slot 12:00~13:00 in the 30 days. As for the time slot 13:00~17:00, the WiFi AP WiFi_AS in the after-school care center corresponds to a confidence level 22/30, the WiFi AP WiFi_O1 in position O1 corresponds to a confidence level 4/30 and the WiFi AP WiFi_O2 in position O2 corresponds to a confidence level 4/30. As for the time slot 17:00~18:00, the signals indicated in the dynamic WiFi information WiFi_NS3, WiFi_NS5 and WiFi_NS7 may correspond to different confidence levels (from 1/30 to 30/30) depending on how many times the corresponding WiFi AP was detected by the tracking device 100 during the time slot 17:00~18:00 in the 30 days.

In step S506, WiFi confidence thresholds are assigned to the different time slots of a day. During each time slot, only the WiFi APs (detected during the data-collection period) at a confidence level greater than the WiFi confidence threshold is trustworthy and used in safe-zone demarcation based on the behavioral model. When no WiFi APs detected during the data-collection period for the specific time slot is at a confidence level greater than the WiFi confidence threshold, the behavioral safe-zone demarcation is not enabled for the specific time slot to reduce unnecessary alarms.

Step S506 is discussed in detail in the following with respect to table 400. The time slots from 00:00 to 07:00 and from 18:00 to 00:00 may correspond to a WiFi confidence threshold 95%, just a little lower than the absolutely high confidence level (100%) of the home WiFi AP WiFi_Home to express a high degree of trust in the surrounding environment. The time slots from 07:00 to 08:00 and 12:00 to 13:00 may correspond to a default WiFi confidence threshold 70%, a little lower than the confidence level (22/20) of the school bus WiFi AP WiFi_SB but not too low to wrongly mark the trustworthy WiFi APs. The time slots from 08:00 to 12:00 each may be correspond to a WiFi confidence threshold 10%, to cover the low confidence level (4/30) of the WiFi APs, WiFi_Home and WiFi_O2, regularly detected during 08:00 to 12:00 on the weekends. The time slots from 13:00 to 17:00 each may be assigned with a WiFi confidence threshold 10%, to cover the low confidence level (4/30) of the WiFi APs, WiFi_O1 and WiFi_O2, regularly detected during 13:00 to 17:00 on the weekends. As for the more non-regular home routes (e.g. R3, R5 and R6) usually taken during the time slot from 17:00 to 18:00, the WiFi confidence threshold is set to 60%.

The WiFi information thresholds may be estimated on the server 114 side based on the information contained in the table 400. In another exemplary embodiment, the user 116 may operate his personal computing device (e.g., the smartphone 118 or the personal computer 120) to communicate with the server 114 and thereby manually set the WiFi confidence thresholds of the different time slots of a day.

Figure 6:
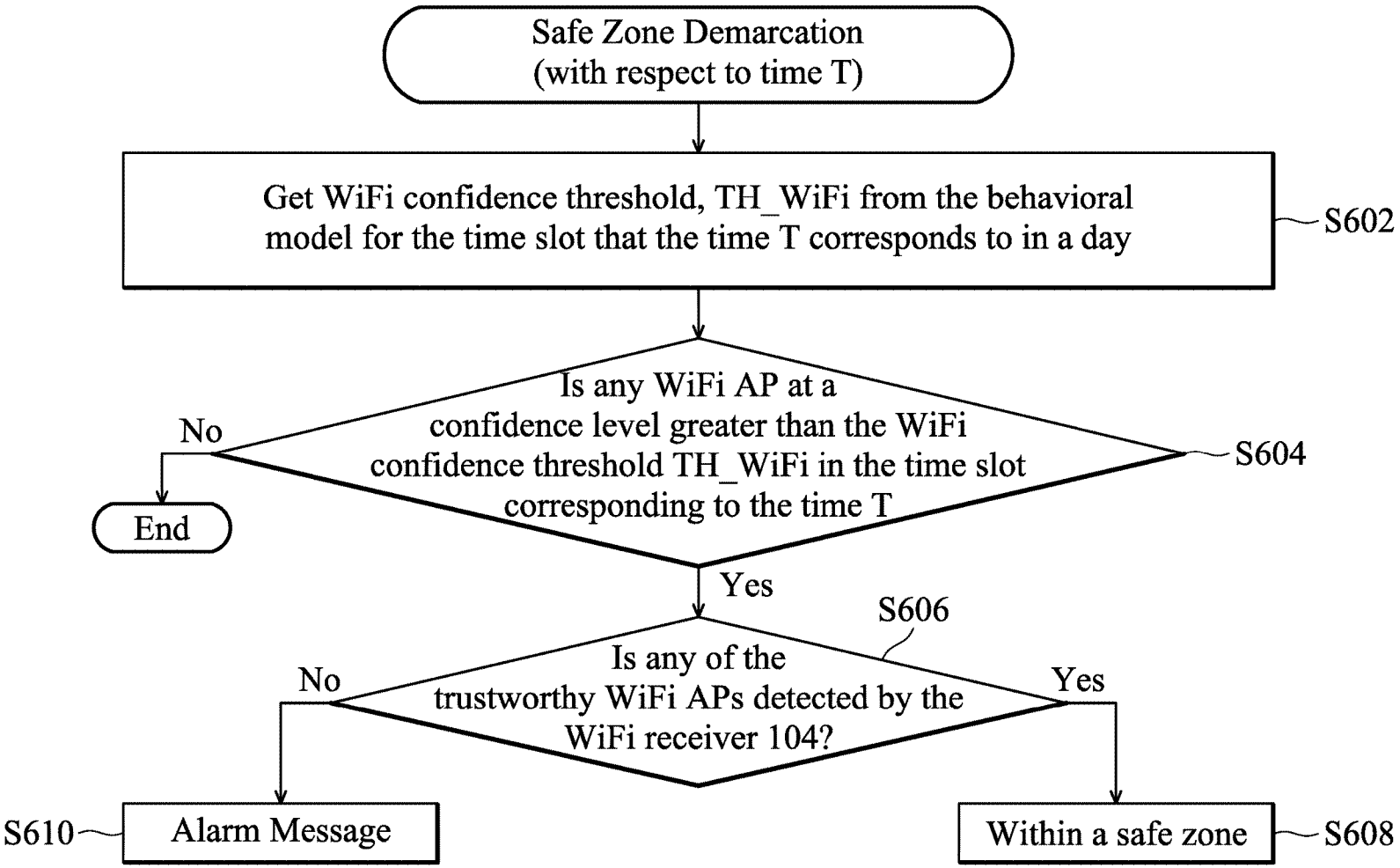
FIG. 6 is flowchart depicting how the behavioral model established according to the procedure of FIG. 5 is used in safe-zone demarcation.

FIG. 6 is flowchart depicting how the behavioral model established according to the procedure of FIG. 5 is used in safe-zone demarcation. As shown, the behavioral model is checked with respect to time T. In step S602, a WiFi confidence threshold, TH_WiFi for the time slot that the time T corresponds to in a day is obtained from the behavioral model. In step S604, it is checked whether any WiFi AP is at a confidence level greater than the WiFi confidence threshold TH_WiFi in the time slot corresponding to the time T. If no, the safe-zone demarcation based on the behavioral model is not enabled to reduce unnecessary alarms. If yes, the WiFi APs at the qualified confidence levels are regarded as trustworthy WiFi APs in the time slot and step S606 is performed to check whether the WiFi receiver 104 is detecting any of the trustworthy WiFi APs. If no, an alarm message is sent to the user 116 in step S610. If yes, it is confirmed in step S608 that the tracking device 100 is within a safe zone.

According to the procedure of FIG. 6, safe-zone demarcation adaptive to habitual behaviors of the tracked object is shown. Going back to the example of the child, the safe-zone demarcation adaptive to the habitual behaviors of the child is discussed in the following paragraphs.

During 00:00~07:00 and 18:00~00:00, the parents are informed once the WiFi AP WiFi_Home is not detected by the WiFi receiver 104 of the tracking device 100. During 07:00~08:00 and 12:00~13:00, the parents are informed once the WiFi AP WiFi_SB on the school bus is not detected by the WiFi receiver 104 of the tracking device 100. During 08:00~12:00, the parents are informed once none of the WiFi APs WiFi_S1, WiFi_S2, WiFi_Home and WiFi_O2 is detected by the WiFi receiver 104 of the tracking device 100. During 13:00~17:00, the parents are informed once none of the WiFi APs WiFi_AS, WiFi_O1 and WiFi_O2 is detected by the WiFi receiver 104 of the tracking device 100. During 17:00~18:00, the parents are informed once the child leaves the usual routes (none of the trustworthy WiFi APs in this time slot is detected by the WiFi receiver 104 of the tracking device 100).

Note that the confidence level is not limited to the rate of appearance during the data collection period. The confidence level may be rated in other ways for correlation analysis of the WiFi detection in each time slot. Furthermore, the data collection period may separate the collection on the weekdays from the collection on the weekends.

When the data collection period is extended to more than 30 days, more habitual behaviors of the tracked object are observed. For example, the confidence levels of the non-regularly detected WiFi APs may be reinforced in the extended data collection period. After the extended data collection period, the non-regularly but frequently detected WiFi APs may be regarded as trustworthy.

In another exemplary embodiment, a tracking-device control method is disclosed, which is discussed with respect to FIG. 1. The tracking-device control method includes the following steps: providing a server 114 for a tracking device 100; operating a WiFi receiver 104 of the tracking device 199 and thereby obtaining WiFi information indicating WiFi access points WiFi_APs detected by the WiFi receiver 104; and operating a telecommunication transceiver 102 of the tracking device 100 to transmit the WiFi information to the server 114 during a data-collection period for behavior analysis of a tracked object equipped with the tracking device 100 and for safe-zone demarcation of the tracking device 100, wherein the safe-zone demarcation of the tracking device 100 is adaptive to habitual behaviors, obtained from the behavior analysis, of the tracked object.

Figure 7:
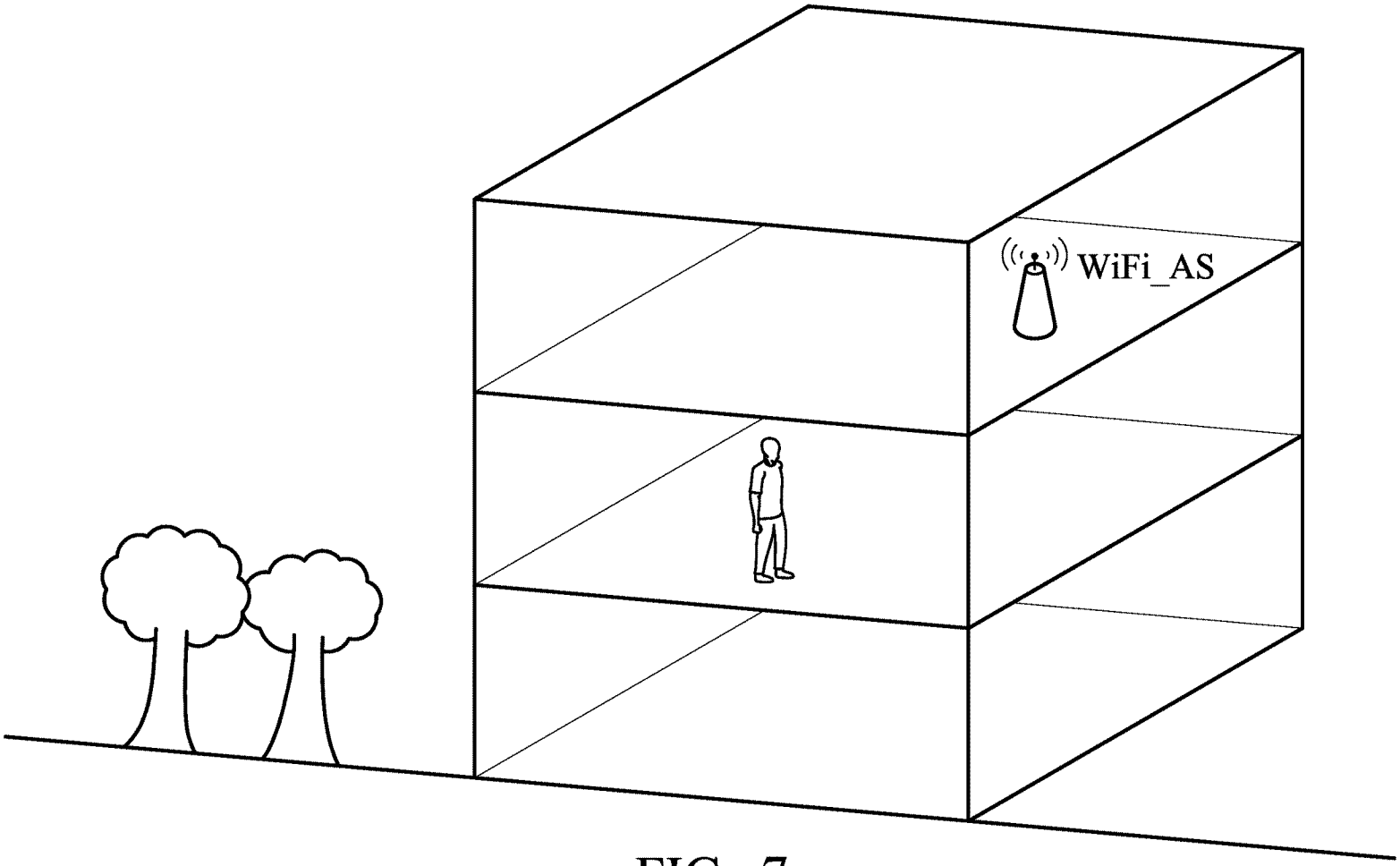
FIG. 7 shows that the safe-zone demarcation based on the behavioral model can recognize the tracked object on the different floors.

FIG. 7 shows that the safe-zone demarcation based on the behavioral model can recognize the tracked object on the different floors. The parents will be informed when the child is taken away from the after-school daycare center even though the kidnapping is still in the same building. During 13:00~17:00, the child is believed to be located in a safe zone when the WiFi AP WiFi_AS is detectable to the tracking device 100. When the child is taken away the trustworthy WiFi AP WiFi_AS and is brought to another floor (e.g., the lower floor shown in FIG. 7), the server 114 will send alarm messages to inform the parents. The safe-zone demarcation in this paper will tell the altitude change of the tracked object.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A tracking device, comprising:

a telecommunication transceiver;

a WiFi receiver; and a microcontroller, configured to operate the telecommunication transceiver to transmit WiFi information to a server during a data-collection period for behavior analysis of a tracked object equipped with the tracking device and for safe-zone demarcation of the tracking device, wherein:

the WiFi information indicates WiFi access points detected by the WiFi receiver;

the safe-zone demarcation of the tracking device is adaptive to habitual behaviors, obtained from the behavior analysis, of the tracked object;

the tracking device is regarded as being located within a safe zone when the tracking device detects any trustworthy WiFi access points approved by the server for the current time slot in accordance with the behavior analysis;

the data-collection period contains N days, where N is a number and each day of the N days is divided into time slots;

the WiFi information collected by the tracking device in the same time slot between the N days is transmitted to the server for a correlation analysis to estimate confidence levels of the WiFi access points for each time slot of a day; and each time slot of a day corresponds to a WiFi confidence threshold to be compared with the confidence levels of the WiFi access points and thereby the trustworthy WiFi access points in each time slot of a day are obtained.

2. The tracking device as claimed in claim 1, wherein:

the data-collection period is regularly repeated and thereby changes of the habitual behaviors of the tracked device are updated in real time.

3. A tracking system, comprising:

a server; and a tracking device, comprising a telecommunication transceiver, a WiFi receiver and a microcontroller, wherein the microcontroller is configured to operate the telecommunication transceiver to transmit WiFi information to the server during a data-collection period for behavior analysis of a tracked object equipped with the tracking device and for safe-zone demarcation of the tracking device, wherein:

the WiFi information indicates WiFi access points detected by the WiFi receiver;

the safe-zone demarcation of the tracking device is adaptive to habitual behaviors, obtained from the behavior analysis, of the tracked object;

the tracking device is regarded as being located within a safe zone when the WiFi receiver of the tracking device detects any trustworthy WiFi access points approved by the server for the current time slot in accordance with the behavior analysis;

the data-collection period contains N days, where N is a number and each day of the N days is divided into time slots;

the WiFi information collected by the tracking device in the same time slot between the N days is transmitted to the server for a correlation analysis to estimate confidence levels of the WiFi access points for each time slot of a day; and each time slot of a day corresponds to a WiFi confidence threshold to be compared with the confidence levels of the WiFi access points and thereby the trustworthy WiFi access points in each time slot of a day are obtained.

4. The tracking system as claimed in claim 3, wherein:

the data-collection period is regularly repeated and thereby changes of the habitual behaviors of the tracked device are updated in real time.

5. A tracking device control method, comprising:

providing a server for a tracking device;

operating a WiFi receiver of the tracking device and thereby obtaining WiFi information indicating WiFi access points detected by the WiFi receiver; and operating a telecommunication transceiver of the tracking device to transmit the WiFi information to the server during a data-collection period for behavior analysis of a tracked object equipped with the tracking device and for safe-zone demarcation of the tracking device, wherein the safe-zone demarcation of the tracking device is adaptive to habitual behaviors, obtained from the behavior analysis, of the tracked object, wherein:

the tracking device is regarded as being located within a safe zone when the WiFi receiver of the tracking device detects any trustworthy WiFi access points approved by the server for the current time slot in accordance with the behavior analysis;

the data-collection period contains N days, where N is a number and each day of the N days is divided into time slots;

the WiFi information collected by the tracking device in the same time slot between the N days is transmitted to the server for a correlation analysis to estimate confidence levels of the WiFi access points for each time slot of a day; and each time slot of a day corresponds to a WiFi confidence threshold to be compared with the confidence levels of the WiFi access points and thereby the trustworthy WiFi access points in each time slot of a day are obtained.

6. The tracking device control method as claimed in claim 5, further comprising:

regularly repeating the data-collection period to update changes of the habitual behaviors of the tracked device in real time.

* * * * *